US009248463B2

(12) United States Patent
Anzalone et al.

(10) Patent No.: US 9,248,463 B2
(45) Date of Patent: Feb. 2, 2016

(54) EXTRACTORS AND PUMP ASSEMBLIES FOR REMOVING VISCOUS CONTENTS FROM THE BOTTOM OF A BOTTLE

(71) Applicants: Michael J. Anzalone, Centereach, NY (US); Norman Lorber, Smithtown, NY (US); Jonathan S. Lorber, Deer Park, NY (US); Michelle R. Lorber, Centereach, NY (US)

(72) Inventors: Michael J. Anzalone, Centereach, NY (US); Norman Lorber, Smithtown, NY (US); Jonathan S. Lorber, Deer Park, NY (US); Michelle R. Lorber, Centereach, NY (US)

( * ) Notice: Subject to any disclaimer, the term of this patent is extended or adjusted under 35 U.S.C. 154(b) by 132 days.

(21) Appl. No.: 13/871,631

(22) Filed: Apr. 26, 2013

(65) Prior Publication Data

US 2014/0319182 A1 Oct. 30, 2014

(51) Int. Cl.
*B05B 11/00* (2006.01)
*B05B 15/00* (2006.01)

(52) U.S. Cl.
CPC ..... *B05B 11/3042* (2013.01); *B05B 15/005* (2013.01); *B05B 11/0008* (2013.01)

(58) Field of Classification Search
CPC ..... B05B 11/3042; B05B 11/0008; B05B 15/005
USPC ..... 222/464.1, 382, 192
See application file for complete search history.

(56) References Cited

U.S. PATENT DOCUMENTS

| | | | | |
|---|---|---|---|---|
| 2,213,846 | A * | 9/1940 | Meyer | 239/326 |
| 2,252,119 | A | 8/1941 | Edmonds | |
| 2,953,170 | A | 9/1960 | Bush | |
| 3,473,221 | A | 10/1969 | Flanders | |
| 3,510,643 | A | 5/1970 | File | |
| 5,075,970 | A | 12/1991 | Albert | |
| D349,770 | S | 8/1994 | Jarnagin | |
| D363,004 | S | 10/1995 | Popek | |
| 5,491,895 | A | 2/1996 | Lee | |
| D413,049 | S | 8/1999 | Bergkvist | |
| 6,102,254 | A | 8/2000 | Ross | |
| 6,347,727 | B1 | 2/2002 | Diaz | |
| 6,675,482 | B1 | 1/2004 | Gilbert, Jr. et al. | |
| D605,638 | S | 12/2009 | Vasilkov | |
| D629,250 | S | 12/2010 | Finell et al. | |
| 8,157,131 | B2 * | 4/2012 | Sim | 222/129 |
| 2002/0070244 | A1 * | 6/2002 | Simard | 222/382 |
| 2005/0279773 | A1 | 12/2005 | Byrd | |
| 2008/0314932 | A1 * | 12/2008 | Stone | 222/209 |
| 2011/0011895 | A1 * | 1/2011 | Michitsuji et al. | 222/382 |
| 2012/0273522 | A1 * | 11/2012 | Bentchev et al. | 222/153.14 |

FOREIGN PATENT DOCUMENTS

| | | | |
|---|---|---|---|
| DE | 10 2007 032372 | A1 | 1/2009 |
| FR | 2912671 | A1 * | 8/2008 |
| GB | 2353828 | A | 3/2001 |

OTHER PUBLICATIONS

PCT International Search Report and Written Opinion dated Sep. 15, 2014 for PCT/US2014/035639.
PCT International Preliminary Report on Patentability dated Nov. 5, 2015 for PCT/US2014/035639.

* cited by examiner

*Primary Examiner* — Donnell Long
(74) *Attorney, Agent, or Firm* — Carter, DeLuca, Farrell & Schmidt, LLP

(57) ABSTRACT

A pump assembly for removing contents from inside a bottle is described. The pump assembly includes a pump; a tube having a first end attached to the pump for drawing contents therein when the pump is actuated; and an extractor positioned on the tube and configured to remove contents from the bottom of the bottle. Kits having various embodiments of the extractor are also described herein, including the configurations of the various embodiments of the extractor.

5 Claims, 12 Drawing Sheets

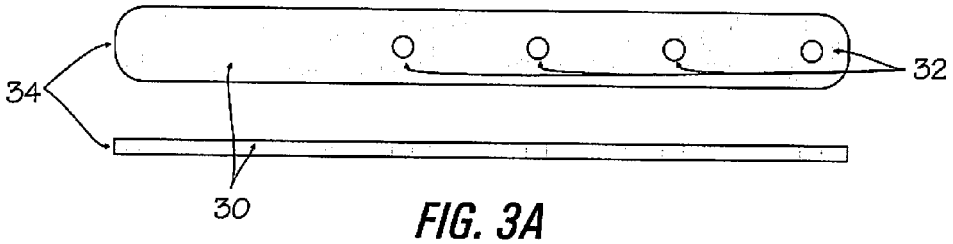
FIG. 3A
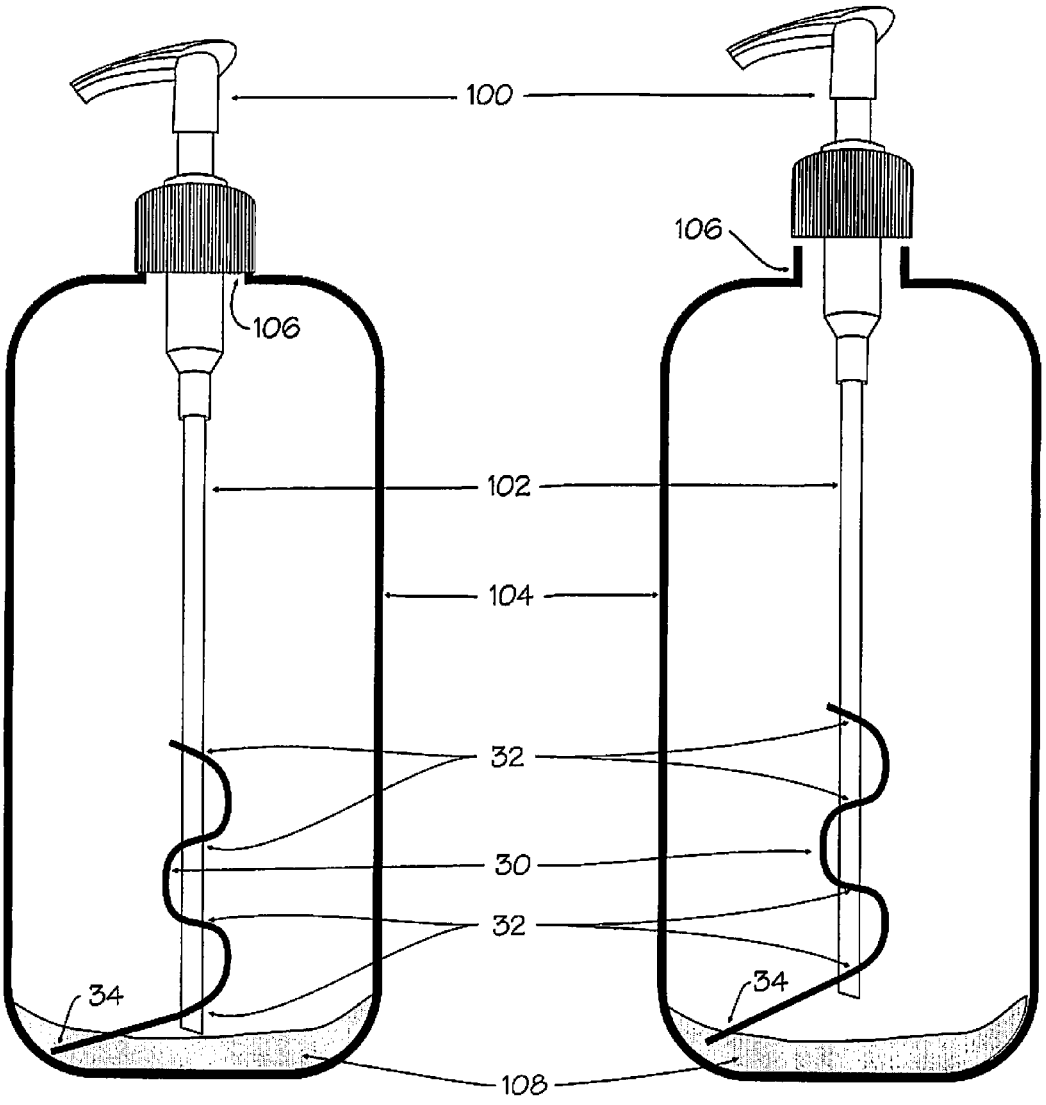
FIG. 3B
FIG. 3C

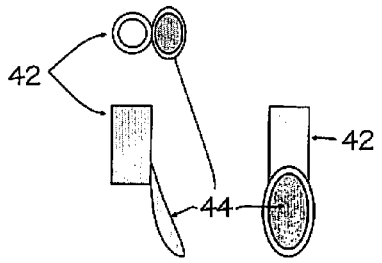
FIG. 4A
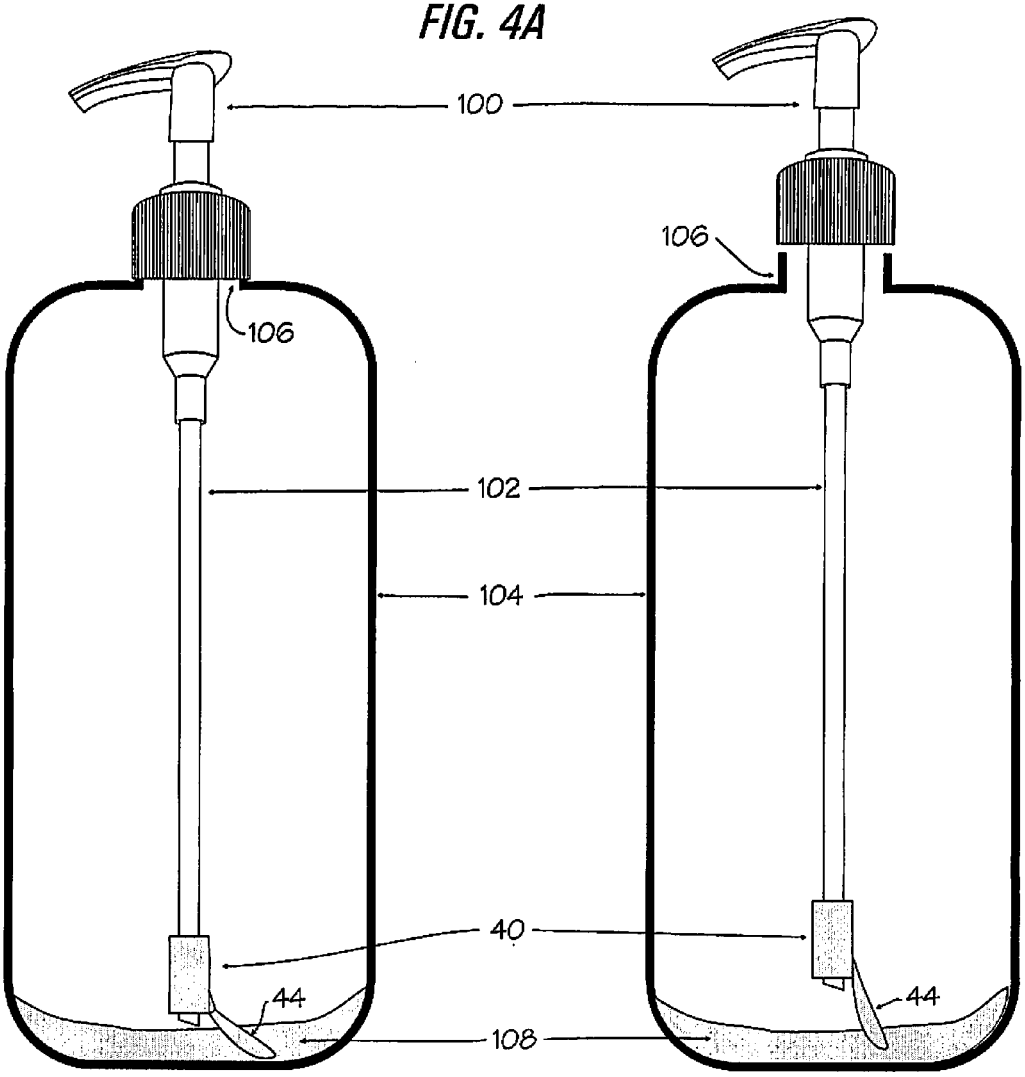
FIG. 4B
FIG. 4C

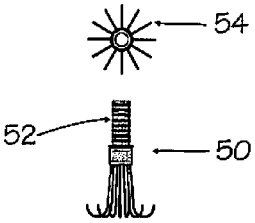
FIG. 5A
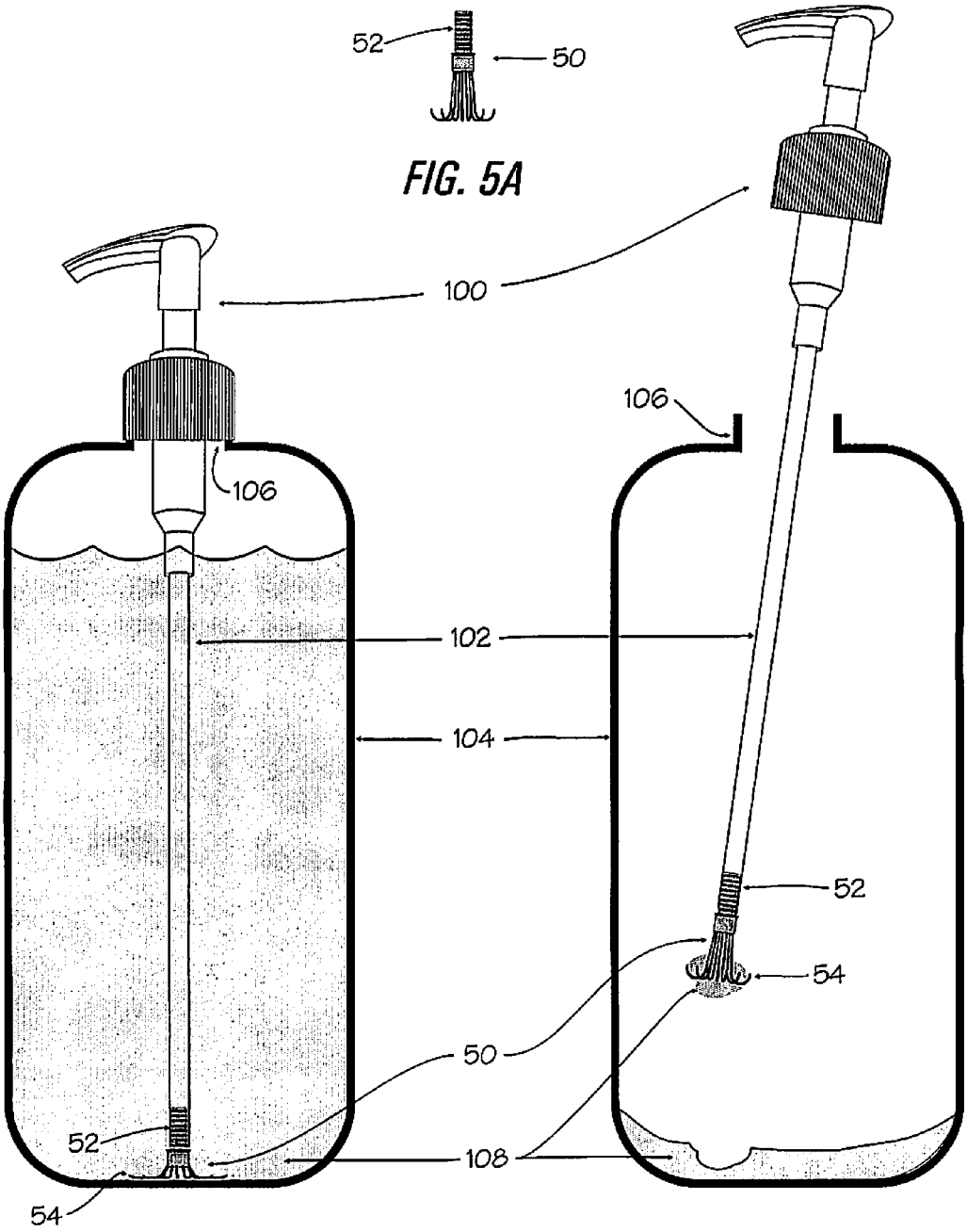
FIG. 5B
FIG. 5C

EXTRACTORS AND PUMP ASSEMBLIES FOR REMOVING VISCOUS CONTENTS FROM THE BOTTOM OF A BOTTLE

BACKGROUND

1. Technical Field

The present disclosure generally relates to devices for removing stored fluids; specifically, to hand-pumping mechanisms for dispensing bottled viscous liquids and attachments thereof.

2. Description of the Relevant Art

Various liquids and liquid-like products are sold and/or stored in bottles. Some non-limiting examples of such products are lotions, soaps, creams, condiments and oils. One manner in which a consumer is able to extract the product enclosed in such bottles is via a hand-pumping mechanism. These hand-pumping mechanisms generally consist of an exposed depressible dispenser connected perpendicularly to a hollow reservoir chamber enclosed within the bottle and connected to one end of a hollow cylindrical tube. Customarily, such pumping mechanism is inserted through the top center of the bottle while the open end of the tube is immersed into the product and extended to the inside center floor of the bottle.

When the dispenser is depressed, the resulting change in pressure within the mechanism causes the product near the opening of the tube to flow out through the tube, reservoir and dispenser. However, if the tube opening is not immersed or nearly-immersed in the product, depressing the dispenser will result in the air contained within the bottle being dispensed, rather than any product which may yet still remain inside the bottle at another location therein.

Since the product must immerse or nearly-immerse the opening of the tube in order to dispense, the hand-pump mechanism does not completely meet the need of the art in effectively and efficiently extracting a liquid from its container. This problem is especially salient when utilizing this mechanism to dispense more viscous liquids. As reported in the September 2009 issue of Consumer Reports magazine, dispensation of skin lotion product via the hand-pump mechanism failed to extract on average 17%-25% of product from each bottle.

While there has been other pertinent art designed to overcome efficiency problems arising from the extraction of bottled liquids—by modifying the structure of the bottle (US 2013/0037557 A1) or by fashioning independent scooping tools for use as an alternative extraction device (US 2012/0280525 A1)—there is nothing which would purport to remedy the problem by modifying the hand-pump mechanism itself.

SUMMARY

In one aspect of the present disclosure, there is provided a pump assembly for removing contents from inside a bottle. The pump assembly includes a pump; a tube attached to the pump for drawing contents therein when the pump is actuated; and an extractor attached or fitted to the tube and configured to remove contents from the bottom of the bottle. In one embodiment, the extractor is a band having a flat bottom and at least two flexible sides attached to the flat bottom. The at least two flexible sides flex when the flat bottom contacts the bottom of the bottle and unflex when the at least two flexible sides do not contact the bottom of the bottle. Contents from the bottom of the bottle can be removed by the flat bottom at the at least two flexible sides.

In another embodiment, the extractor is a paddle having a receiving member for attaching or fitting to the tube and an elongated tab extending from the receiving member. The tab extends towards the bottom of the bottle when placed inside the bottle.

In still another embodiment, the extractor is a ribbon having a plurality of openings for inserting the tube therethrough, such that after attaching or fitting the ribbon to said tube, the ribbon has a serpentine shape.

In yet another embodiment, the extractor is a spoon having a receiving member for attaching or fitting to the tube and a scooping member extending from the receiving member. The scooping member extends towards the bottom of the bottle when placed inside the bottle.

In a further embodiment, the extractor includes a plurality of fingers. The plurality of fingers are curved at an end nearest the bottom of the bottle when the extractor is placed inside the bottle. The plurality of fingers are configured to spread out when they contact the bottom of the bottle.

In another embodiment, the extractor is a tube having a diameter greater than a diameter of the tube attached to the pump.

In another aspect of the present disclosure, there is provided a kit having a plurality of extractors having structure for attaching or fitting to a tube of a pump assembly. Each of the plurality of extractors is dimensioned and configured to remove contents from the bottom of a bottle. The kit further includes the pump assembly. The pump assembly includes the tube and a pump.

In still another aspect of the present disclosure, there is provided an extractor for attaching or fitting to a tube of a pump assembly of the type having a pump capable of being actuated for drawing contents from inside a bottle into the tube. The extractor has at least one surface for removing contents from the bottom of the bottle. The extractor according to this aspect of the present disclosure can be any type of extractor within the teachings and scope of the present disclosure, such as, for example, the extractors described above with reference to the first aspect of the present disclosure.

In a further embodiment of the present disclosure, there is provided a pump assembly for removing contents from inside a bottle. The pump assembly includes a pump; a tube having a first end attached to the pump for drawing contents therein when the pump is actuated; and an extractor formed at a second end of the tube opposite the first end. The extractor is configured to remove contents from the bottom of the bottle.

BRIEF DESCRIPTION OF THE DRAWINGS

The advantages and features of the present disclosure will become more appreciated and better understood when considered in conjunction with the drawings:

FIG. 3A is an overhead and perspective view of a ribbon embodiment of the present disclosure.

FIG. 3B is a perspective view of the ribbon embodiment of the present disclosure attached or fitted to the pump tube, contained in a bottle of residual vicious liquid product, with the pump fully seated.

FIG. 3C is a perspective view of the ribbon embodiment of the present disclosure attached or fitted to the pump tube, contained in a bottle of residual vicious liquid product, with the pump dislodged from the bottleneck.

FIG. 4A is an overhead, side perspective, and frontal perspective view of a spoon embodiment of the present disclosure.

FIG. 4B is a perspective view of the spoon embodiment of the present disclosure attached or fitted to the pump tube, contained in a bottle of residual vicious liquid product, with the pump fully seated.

FIG. 4C is a perspective view of the spoon embodiment of the present disclosure attached of fitted to the pump tube, contained in a bottle of residual vicious liquid product, with the pump dislodged from the bottleneck.

FIG. 5A is an overhead and perspective view of a claw embodiment of the present disclosure.

FIG. 5B is a perspective view of the claw embodiment of the present disclosure attached or fitted to the pump tube, contained in a full bottle of vicious liquid product, with the pump fully seated.

FIG. 5C is a perspective view of the claw embodiment of the present disclosure attached of fitted to the pump tube, contained in a bottle of residual vicious liquid product, with the pump dislodged from the bottleneck.

DETAILED DESCRIPTION

In the Summary and Brief Description of the Drawings sections above, in this Detailed Description, in the Claims below, and in the accompanying drawings, reference is made to particular features (including method steps or acts) of the present disclosure. It is to be understood that the disclosure in this specification includes combinations of parts, features, or aspects disclosed herein. For example, where a particular feature is disclosed in the context of a particular aspect or embodiment of the present disclosure, or a particular claim, that feature can also be used, to the extent possible, in combination with and/or in the context of other particular aspects and embodiments of the present disclosure, and in the disclosure generally.

The term "comprises" and grammatical equivalents thereof are used herein to mean that other components, ingredients, steps, acts, etc. are optionally present. For example, an article "comprising (or "which comprises") component A, B, and C can consist of (i.e., contain only) components A, B, and C, or can contain not only components, A, B, and C but also one or more additional components, elements, features, ingredients, steps, acts, etc.

Where reference is made herein to a method comprising two or more defined steps or acts, the defined steps or acts can be carried out in any order or simultaneously (except where the context excludes that possibility); and the method can include one or more other steps or acts which are carried out before any of the defined steps or acts, between two of the defined steps or acts, or after all the defined steps or acts (except where the context excludes that possibility).

The term "at least" means one or more than one. When, in this specification, a range is given as "(a first number) to (a second number)" or "(a first number) (a second number)," this means a range whose lower limit is the first number and whose upper limit is the second number. For example, 25 mm to 100 mm means a range whose lower limit is 25 mm, and whose upper limit is 100 mm.

Various embodiments of extractors for extracting or removing viscous contents from the bottom of a bottle according to the present disclosure are described herein. The word "bottle" is defined herein and in the claims to include any enclosure (bottles, containers, tubes, etc.) having or adapted for inserting therein a pump mechanism or assembly having a hand pump for pumping contents from inside the enclosure, such as, for example, a shampoo bottle.

FIGS. 1A, 1B, 1C, 1D, 1E and 1F illustrate one embodiment of the present disclosure.

Figures 1A, 1B:
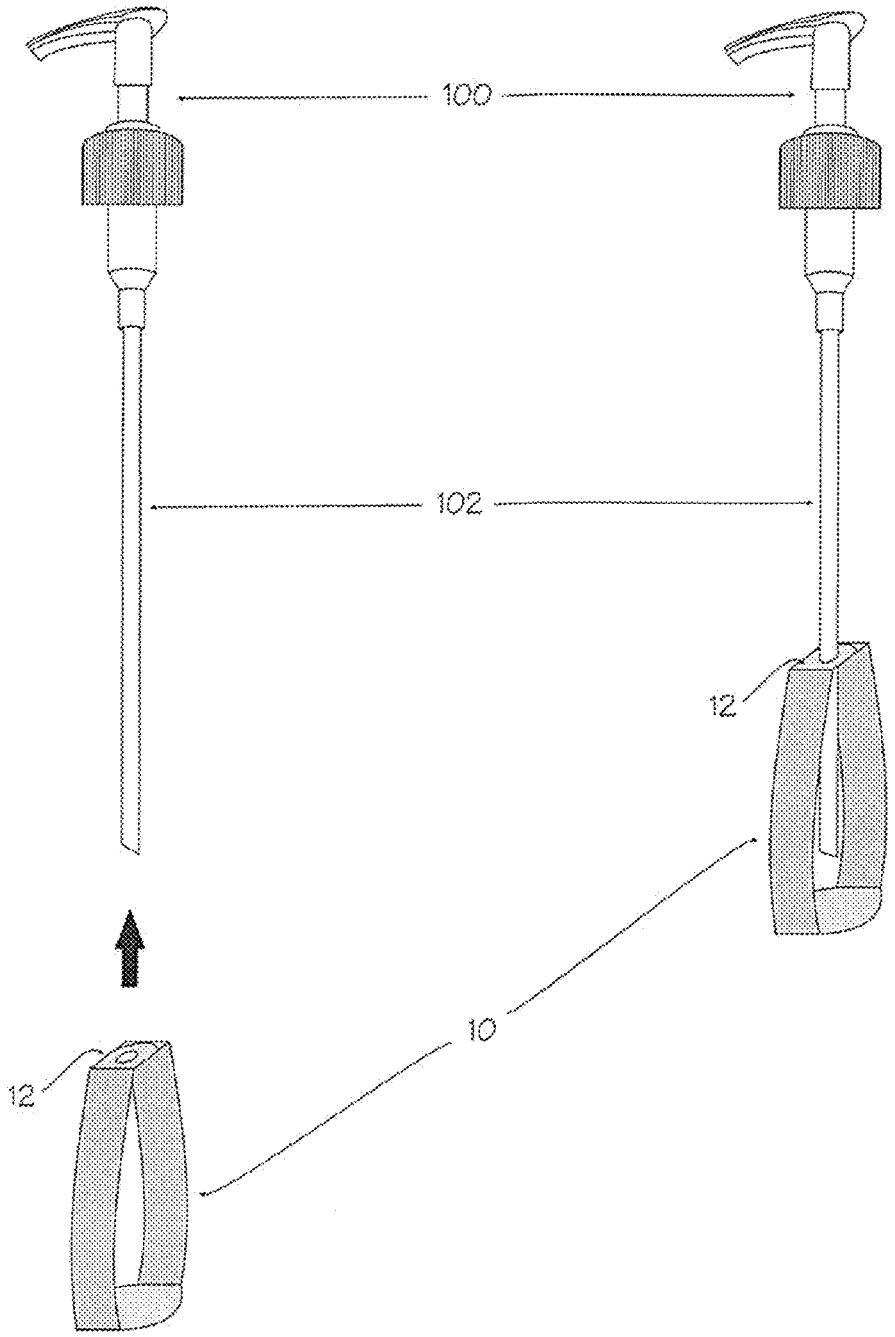
FIG. 1A is a perspective view of a band embodiment of the present disclosure unattached to the pump tube.
FIG. 1B is a perspective view of the band embodiment of the present disclosure attached to the pump tube.

FIG. 1A shows a circular band 10 with a flat bottom, a flat top having a receiving member 12, and two curved sides connecting the flat top of the band 10 to the flat bottom of the band 10. The band 10 is made out of a solid, flexible material. The band 10 attaches or fits to a pump tube 102 by inserting the pump tube 102 through the receiving member 12 in the flat top of the band 10.

FIG. 1B shows the band 10 attached to the pump tube 102. The diameter of the receiving member 12 is to be of such a size as to allow for the band 10 to be friction fit to the pump tube 102, thereby prohibiting the band 10 from sliding across the pump tube 102 unless manual force is applied.

Figures 1C, 1D:
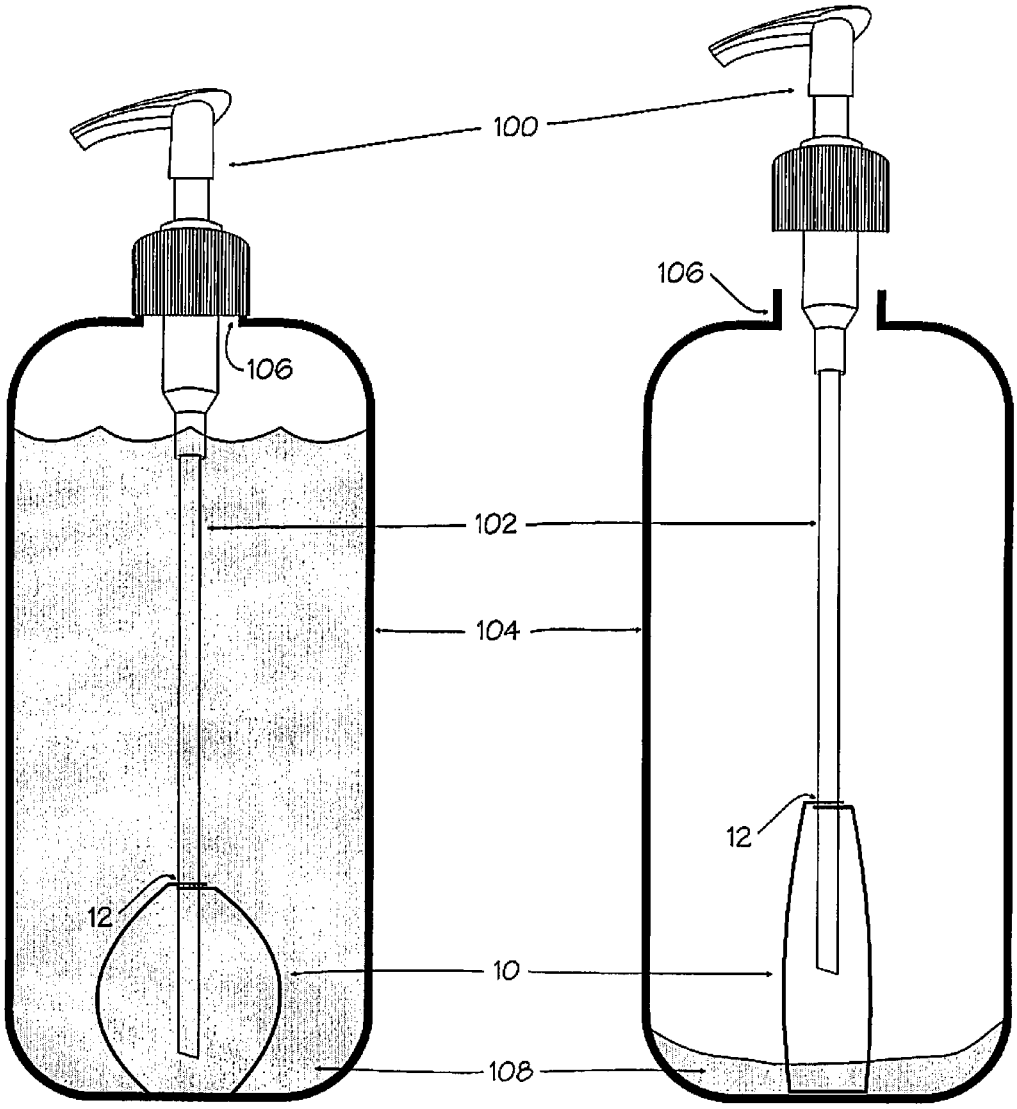
FIG. 1C is a perspective view of the band embodiment of the present disclosure attached or fitted to the pump tube, contained in a full bottle of vicious liquid product, with the pump fully seated.
FIGS. 1D, 1E and 1F are each perspective views of the band embodiment of the present disclosure attached or fitted to the pump tube, contained in a bottle of residual vicious liquid product, with the pump dislodged from the bottleneck.

FIG. 1C shows the band 10 in a full bottle 104 of viscous liquid product 108, with a pump 100 fully seated, and the band 10 partially compressed and resting on the bottom of the bottle 104. The band 10 itself is to be of such width and malleability as to easily fit through the opening of the bottle 104 for which the pump 100 is to be received, when the band 10 is attached or fitted to the pump tube 102 (as shown in FIG. 1B). The partial compression of the sides of the band 10 allows the flat bottom to rest on the inside floor of the bottle 104 while simultaneously allowing the pump 100 to be secured to the bottle 104 in its original position. After the pump 100, with the band 10 attached thereto, has been inserted through the bottleneck 106 and duly secured by the user thereto, the pump 100 continues to function in the same manner and with the same result as it would without the band 10 so attached.

FIG. 1D shows the band 10 attached to the pump tube 102 inside a bottle 104 containing residual viscous liquid product 108, with the pump 100 unsecured from the bottleneck 106 but still inside the bottle 104. The bottle 104 contains such a volume of viscous liquid product 108 that is too low for the base of the pump tube 102 to be submersed therein, when the pump 100 is secured to the bottle 104. While this residual amount of viscous liquid product 108 is out of reach of the pump tube 102, it is still accessible by the band 10, which is no longer compressed when the pump 100 is detached from the bottle 104.

Figures 1E, 1F:
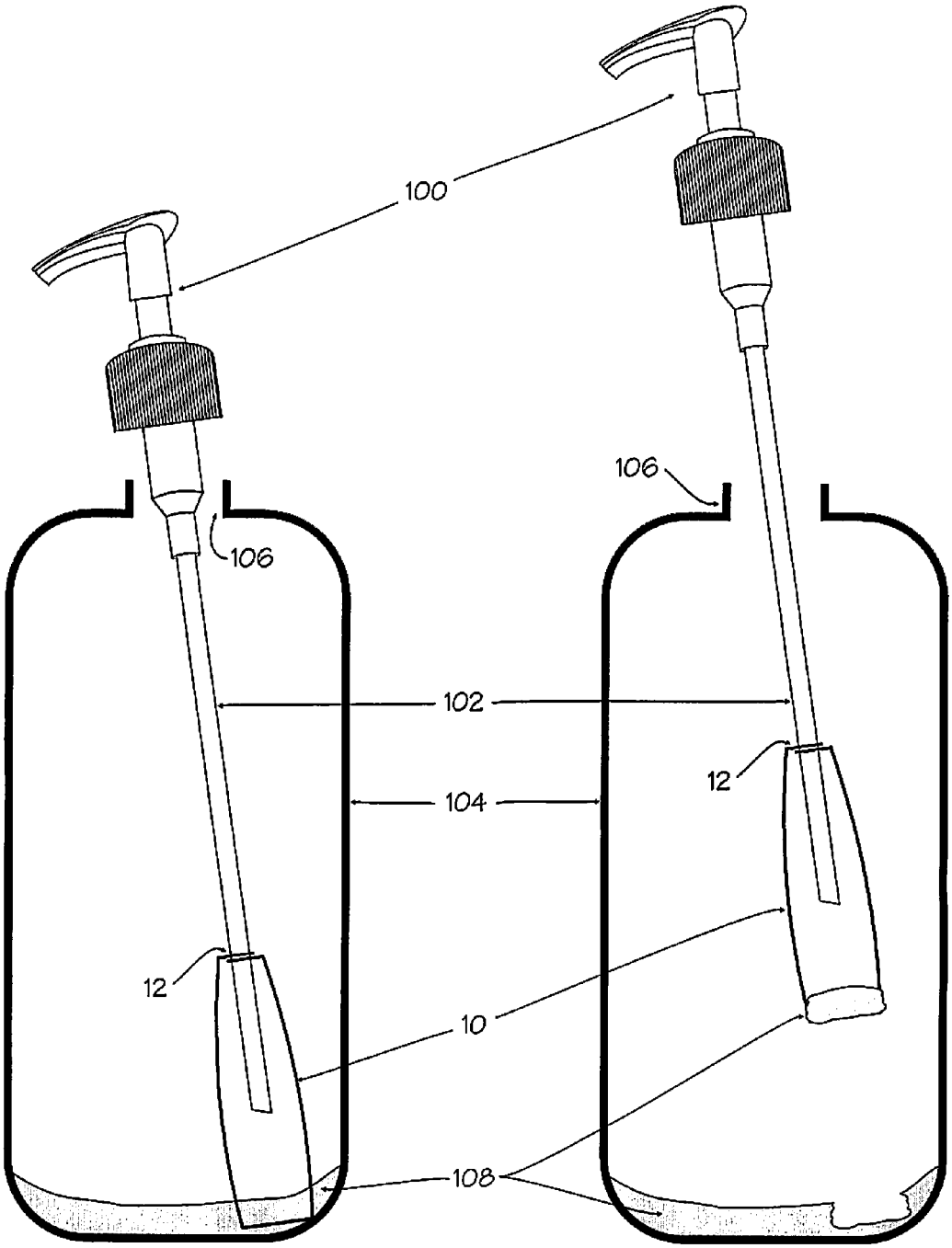

FIGS. 1E & 1F show the band 10 being used to extract the residual viscous liquid product 108 from the bottom and sides of the bottle 104. Specifically, FIG. 1E shows the flat bottom of the band 10 being submersed in the residual viscous liquid product 108, when the pump 100 is unsecured from the bottleneck 106 but still inside the bottle 104. FIG. 1F shows a potion of the residual viscous liquid product 108 being recovered from the bottom of the bottle 104 and resting on the floor of the flat bottom of the band 10.

Figures 2A, 2B, 2C:
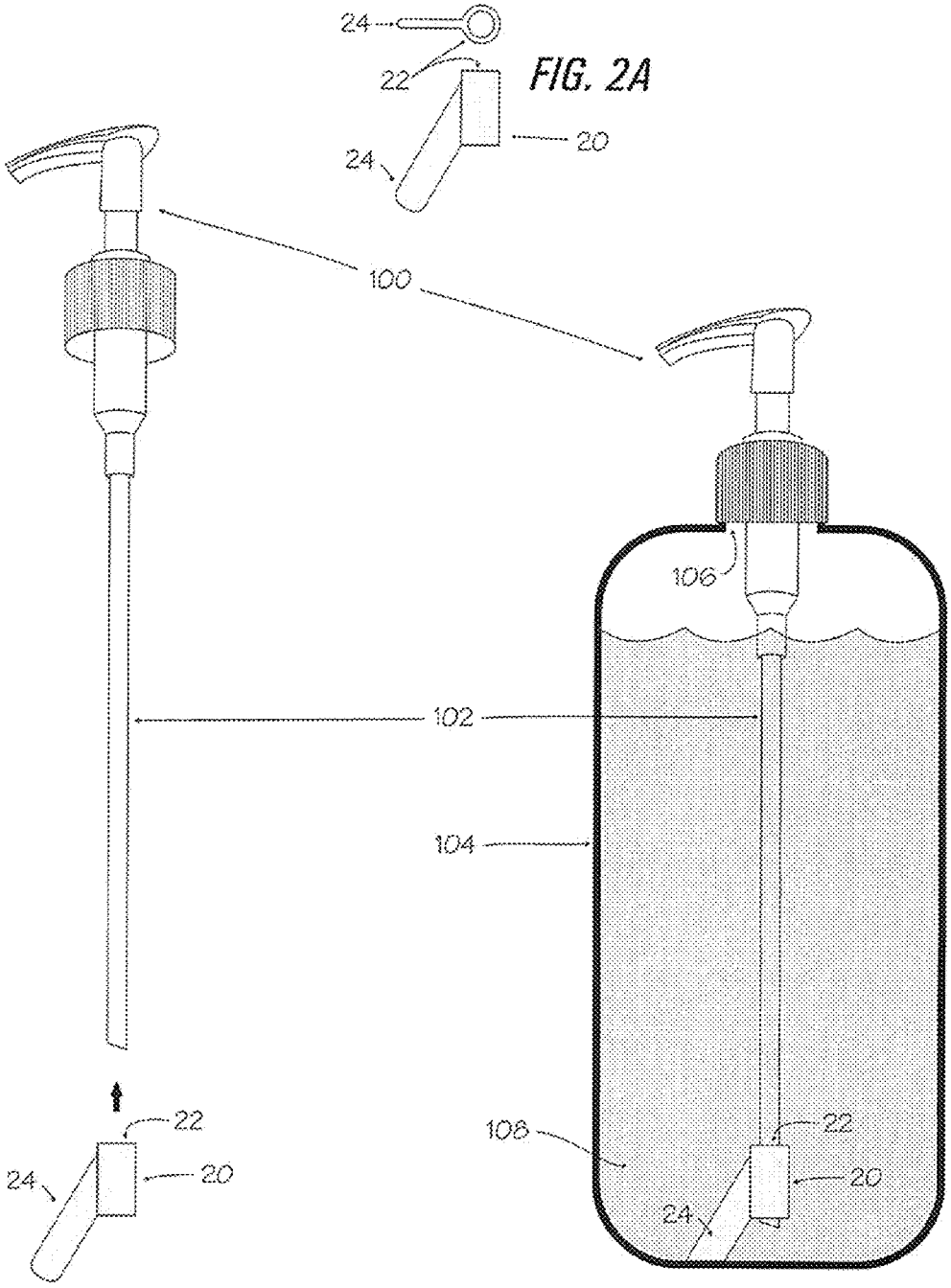
FIG. 2A is an overhead and perspective view of a paddle embodiment of the present disclosure.
FIG. 2B is a perspective view of the paddle embodiment of the present disclosure unattached to the pump tube.
FIG. 2C is a perspective view of the paddle embodiment of the present disclosure attached or fitted to the pump tube, contained in a full bottle of vicious liquid product, with the pump fully seated.

FIGS. 2A, 2B and 2C illustrate another embodiment of the present disclosure, whereby a paddle 20 is attached to the pump tube 102.

FIG. 2A shows overhead and side views of a paddle 20 having a cylindrical receiving member 22 and an elongated tab 24 extending downward from the side of the receiving member 22 on an angle.

FIG. 2B shows the paddle 20 in position to be attached or fitted to the pump tube 102. The diameter of the opening of the receiving member 22 is to be of such a size as to allow for the paddle 20 to be friction fit to the pump tube 102, thereby prohibiting the paddle 20 from sliding across the pump tube 102 unless manual force is applied.

FIG. 2C shows the paddle 20 in a full bottle 104 of viscous liquid product 108, with the pump 100 fully seated. The tab 24 is to be of such width and malleability as to lend itself to be bent from side to side when pressure is applied to the tab 24. After the pump 100, with the paddle 20 attached thereto, has been inserted through the bottleneck 106 and duly secured by the user thereto, the pump 100 continues to function in the same manner and with the same result as it would without the paddle 20 so attached.

Figures 2D, 2E:
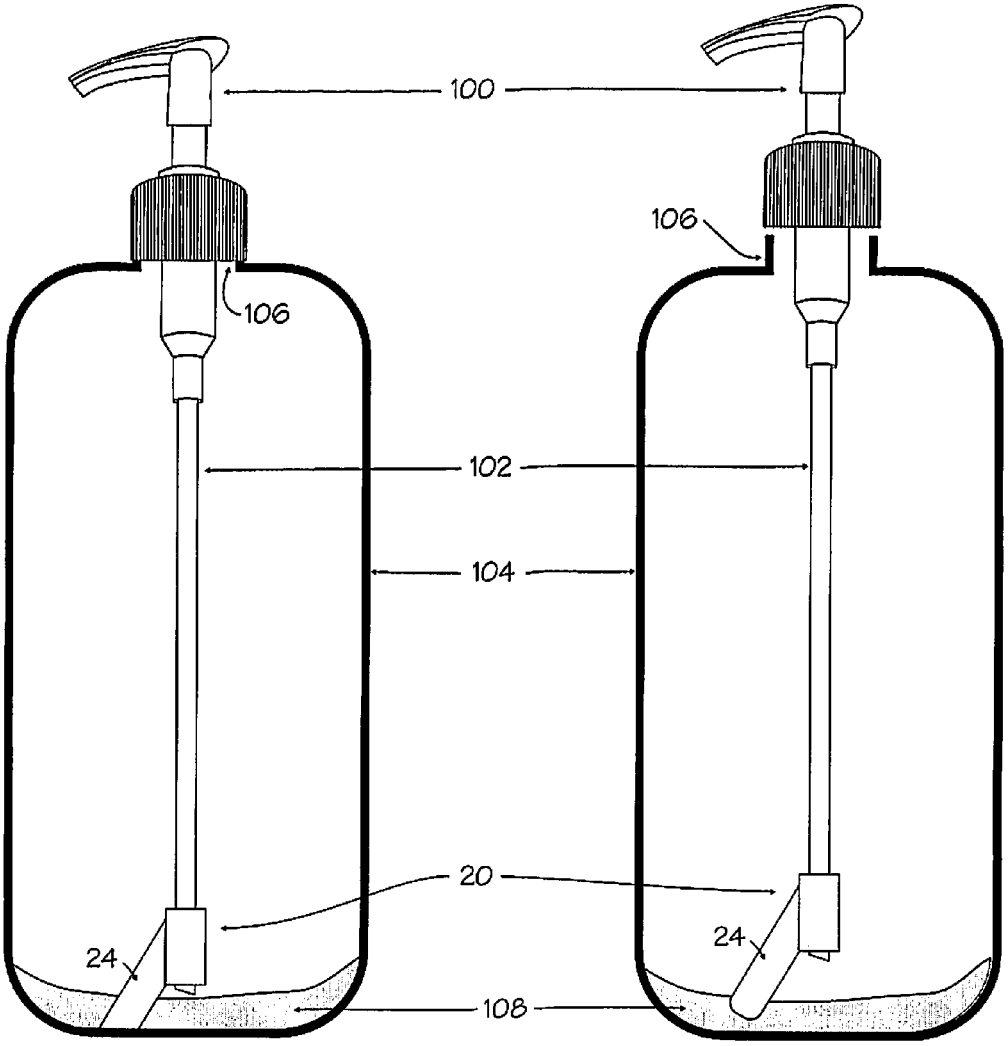
FIG. 2D is a perspective view of the paddle embodiment of the present disclosure attached or fitted to the pump tube, contained in a bottle of residual vicious liquid product, with the pump fully seated.
FIG. 2E is a perspective view of the paddle embodiment of the present disclosure attached or fitted to the pump tube, contained in a bottle of residual vicious liquid product, with the pump dislodged from the bottleneck.

FIG. 2D shows the paddle 20 attached to the pump tube 102 inside a bottle 104 containing residual viscous liquid product 108, with the tab 24 slightly folded and the pump 100 fully seated. The bottle 104 contains such a volume of residual viscous liquid product 108 that is too low for the base of the pump tube 102 to be submersed therein, when the pump 100 is secured to the bottle 104. While this residual amount of viscous liquid product 108 is out of reach of the pump tube 102, it is still accessible by the tab 24 of the paddle 20.

FIG. 2E shows the pump 100 detached from the bottle 104, with the tab 24 extended and able to reach the bottom of the bottle 104.

FIGS. 3A, 3B and 3C illustrate another embodiment of the present disclosure.

FIG. 3A shows overhead and side views of a solid, flexible ribbon 30 with perforations 32 the upper and middle sections thereof. The ribbon 30 is attached or fitted to the pump 100 by weaving the pump tube 102 back and forth, first, through the topmost perforation 32, then, through each perforation 32 following in sequence thereafter. It is preferred, but not necessary, that this embodiment of the present disclosure have four perforations 32. When attached or fitted to the tube 102, the ribbon 30 has a serpentine shape as shown by the figures.

FIG. 3B shows the ribbon 30 attached to the pump tube 102 inside a bottle 104 containing residual viscous liquid product 108, with the pump 100 fully seated. After the pump 100, with the ribbon 30 attached thereto, has been inserted through the bottleneck 106 and duly secured by the user thereto, the pump 100 continues to function in the same manner and with the same result as it would without the ribbon 30 so attached. The bottle 104 contains such a volume of residual viscous liquid product 108 that is too low for the base of the pump tube 102 to be submersed therein, when the pump 100 is secured to the bottle 104. While this residual amount of viscous liquid product 108 is out of reach of the pump tube 102, it is still accessible by the tail 34 of the ribbon 30.

FIG. 3C shows the pump 100 detached from the bottle 104, with the tail 34 of the ribbon 30 extended and able to reach the bottom of the bottle 104.

FIGS. 4A, 4B and 4C illustrate another embodiment of the present disclosure.

FIG. 4A shows overhead and side views of a solid, flexible spoon 40 having a cylindrical receiving member 42 and a concave scooping member 44 extending downward from the side of the receiving member 42 on an angle. The diameter of the opening of the receiving member 42 is to be of such a size as to allow for the spoon 40 to be friction fit to the pump tube 102, thereby prohibiting the spoon 40 from sliding across the pump tube 102 unless manual force is applied.

FIG. 4B shows the spoon 40 attached or fitted to the pump tube 102 inside a bottle 104 containing residual viscous liquid product 108, with the scooping member 44 slightly folded and the pump 100 fully seated. The scooping member 44 is to be of such malleability as to lend itself to be bent slightly upward when pressure is applied to the underside thereof. After the pump 100, with the spoon 40 attached thereto, has been inserted through the bottleneck 106 and duly secured by the user thereto, the pump 100 continues to function in the same manner and with the same result as it would without the scoop so attached. The bottle 104 contains such a volume of residual viscous liquid product 108 that is too low for the base of the pump tube 102 to be submersed therein, when the pump 100 is secured to the bottle 104. While this residual amount of viscous liquid product 108 is out of reach of the pump tube 102, it is still accessible by the spoon 40.

FIG. 4C shows the pump 100 detached from the bottle 104, with the scooping member 44 extended and able to reach the bottom of the bottle 104.

FIGS. 5A, 5B and 5C illustrate another embodiment of the present disclosure.

FIG. 5A shows overhead and side views of claw 50 having an insertion member 52 atop a series of fingers 54. Each finger 54 is composed of a solid, flexible material that extends vertically down from the outer edge of the base of the insertion member 52 next to one another in a series so as to enclose the base of the insertion member 52 within a circle. The bottom of each of finger 54 curls up slightly in the shape of a crescent where the end of each finger 54 points upward when in the resting position.

FIG. 5B shows the claw 50 attached or fitted to the pump tube 102 inside a full bottle 104 of viscous liquid product 108, with the fingers 54 partially compressed and flared out perpendicular to the plane of the pump tube 102, and the pump 100 fully seated. The diameter of the insertion member 52 is to be of such a size as to allow for the claw 50 to be friction fit to inside of the pump tube 102, thereby prohibiting the claw 50 from inadvertently falling out the bottom the pump tube 102 unless manual force is applied. Each finger 54 is to be of such malleability as to lend itself to be bent slightly and flare out when pressure is applied to the underside thereof. After the pump 100, with the claw 50 attached thereto, has been inserted through the bottleneck 106 and duly secured by the user thereto, the pump 100 continues to function in the same manner and with the same result as it would without the claw 50 so attached.

FIG. SC shows the claw 50 attached to the pump tube 102 inside a bottle 104 containing residual viscous liquid product 108, with the pump 100 unsecured from the bottleneck 106 but still inside the bottle 104. The bottle 104 contains such a volume of residual viscous liquid product 108 that is too low for the base of the pump tube 102 to be submersed therein, when the pump 100 is secured to the bottle 104. While this residual amount of viscous liquid product 108 is out of reach of the pump tube 102, it is still accessible by the fingers 54, which is no longer compressed when the pump 100 is detached from the bottle 104. As the fingers 54 have recoiled back to their resting position, the fingers 54 are able to retain some of the residual viscous liquid product 108, when the pump 100 is removed from the bottle 104.

FIGS. 6A, 6B, 6C and 6D illustrate another embodiment of the present disclosure as a modification of the structure of a standard pump tube 102. The bottom end of modified pump tube 60 is sheared in half parallel to length thereof, thus forming a concave cup 62 from the remaining bottom end of the modified pump tube 60. The bottle 104 contains such a volume of residual viscous liquid product 108 that is too low for the base of the modified pump tube 60 to be submersed therein, when the pump 100 is secured to the bottle 104.

Figures 6A, 6B:
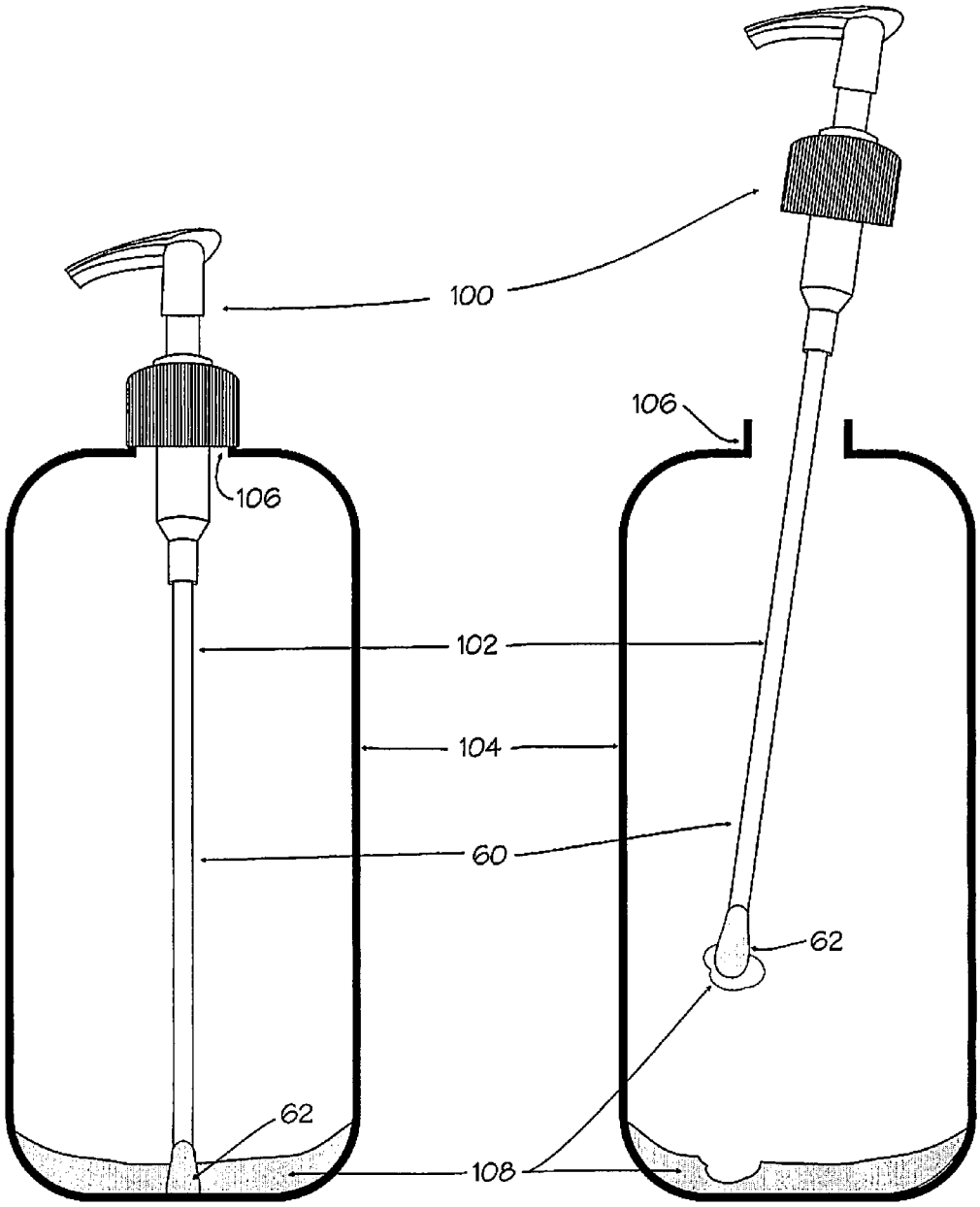
FIG. 6A is a frontal perspective view of a modified pump tube embodiment of the present disclosure, contained in a bottle of residual vicious liquid product, with the pump fully seated.
FIG. 6B is a frontal perspective view of the modified pump tube embodiment of the present disclosure, contained in a bottle of residual vicious liquid product, with the pump dislodged from the bottleneck.
Figures 6C, 6D:
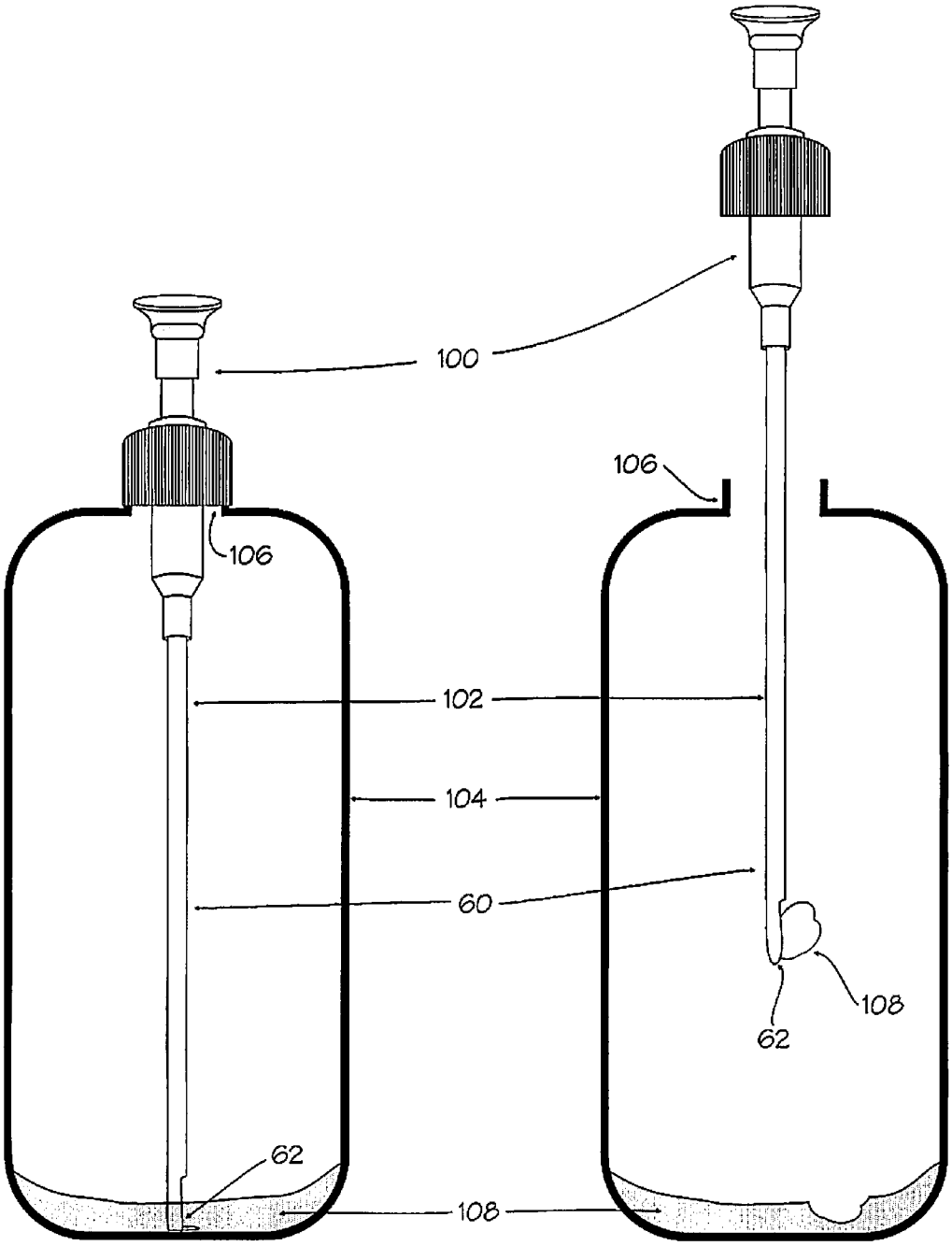
FIG. 6C is a side perspective view of the modified pump tube embodiment of the present disclosure, contained in a bottle of residual vicious liquid product, with the pump fully seated.
FIG. 6D is a side perspective view of the modified pump tube embodiment of the present disclosure, contained in a bottle of residual vicious liquid product, with the pump dislodged from the bottleneck.

FIGS. 6A and 6B illustrate frontal views of the modified pump tube 60. FIGS. 6C and 6D illustrate side views of the modified pump tube 60.

FIGS. 6A and 6C show the modified pump tube 60 inside a bottle 104 containing residual viscous liquid product 108, with a cup 62 slightly folded and the pump 100 fully seated. The cup 62 is to be of such malleability as to lend itself to be bent slightly when pressure is applied to the underside thereof.

FIGS. 6B and 6D show the modified pump tube 60 inside a bottle 104 containing residual viscous liquid product 108, with the pump 100 unsecured from the bottleneck 106 but still inside the bottle 104. While this residual amount of viscous liquid product 108 is out of reach of the modified pump tube 60 for the purpose of hand-pumping out the liquid, it is still accessible by the cup 62, which is no longer folded when the pump 100 is detached from the bottle 104. As the cup 62 has recoiled back to its resting position, the cup 62 is able to retain some of the residual viscous liquid product 108, when the pump 100 is removed from the bottle 104.

FIGS. 6A and 6B illustrate frontal views of the modified pump tube 60. FIGS. 6C and 6D illustrate side views of the modified pump tube 60.

Figures 7A, 7B:
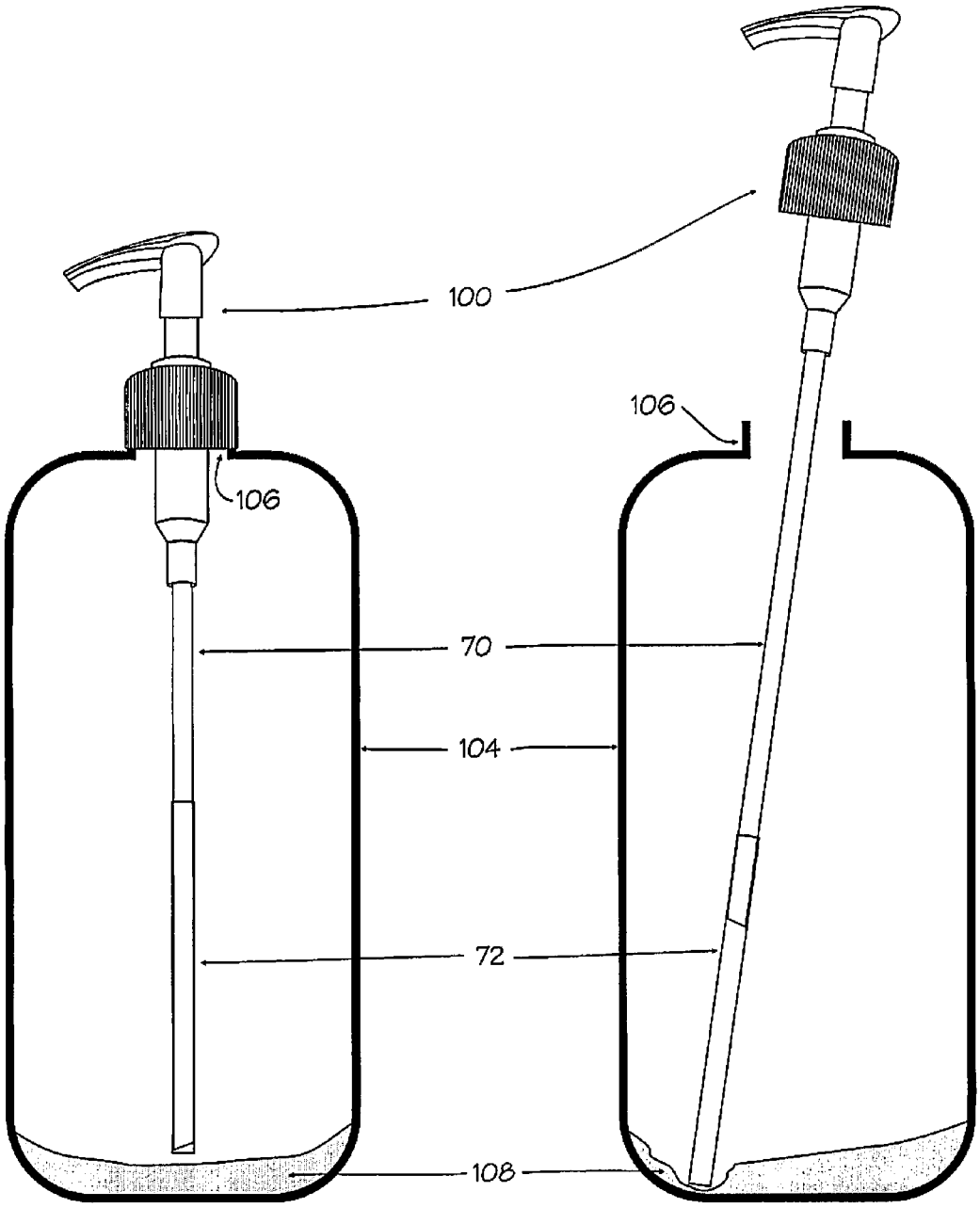
FIG. 7A is a perspective view of a telescoping embodiment of the present disclosure attached or fitted to the pump tube, contained in a bottle of residual vicious liquid product, with the pump fully seated.
FIG. 7B is a perspective view of the telescoping embodiment of the present disclosure attached or fitted to the pump tube, contained in a bottle of residual vicious liquid product, with the pump dislodged from the bottleneck.

FIGS. 7A and 7B illustrate frontal views of modified pump tube 70 inside a bottle 104 containing residual viscous liquid product 108 according to another embodiment of the present disclosure. The modified pump tube 70 includes a telescoping tube 72 configured to extend from tube 70 as shown by FIG. 7B. Alternatively, the tube 70 can be made to be extendible, such as, for example, having an elbow near the end of the tube 70 closest to the bottom of the bottle 104, where the elbow extends when pulled.

In particular, FIG. 7B shows the modified pump tube 70 inside a bottle 104 containing residual viscous liquid product 108, with the pump 100 unsecured from the bottleneck 106 but still inside the bottle 104. While this residual amount of viscous liquid product 108 is out of reach of the modified pump tube 70 for the purpose of hand-pumping out the liquid, it is still accessible by the telescoping tube 72, which is extendible by a user. The telescoping tube 72 is able to reach the liquid product 108 at the bottom of the bottle 104. The pump 100 can then be used to pump the product from the bottom of the bottle 104.

Figures 8A, 8B, 8C:
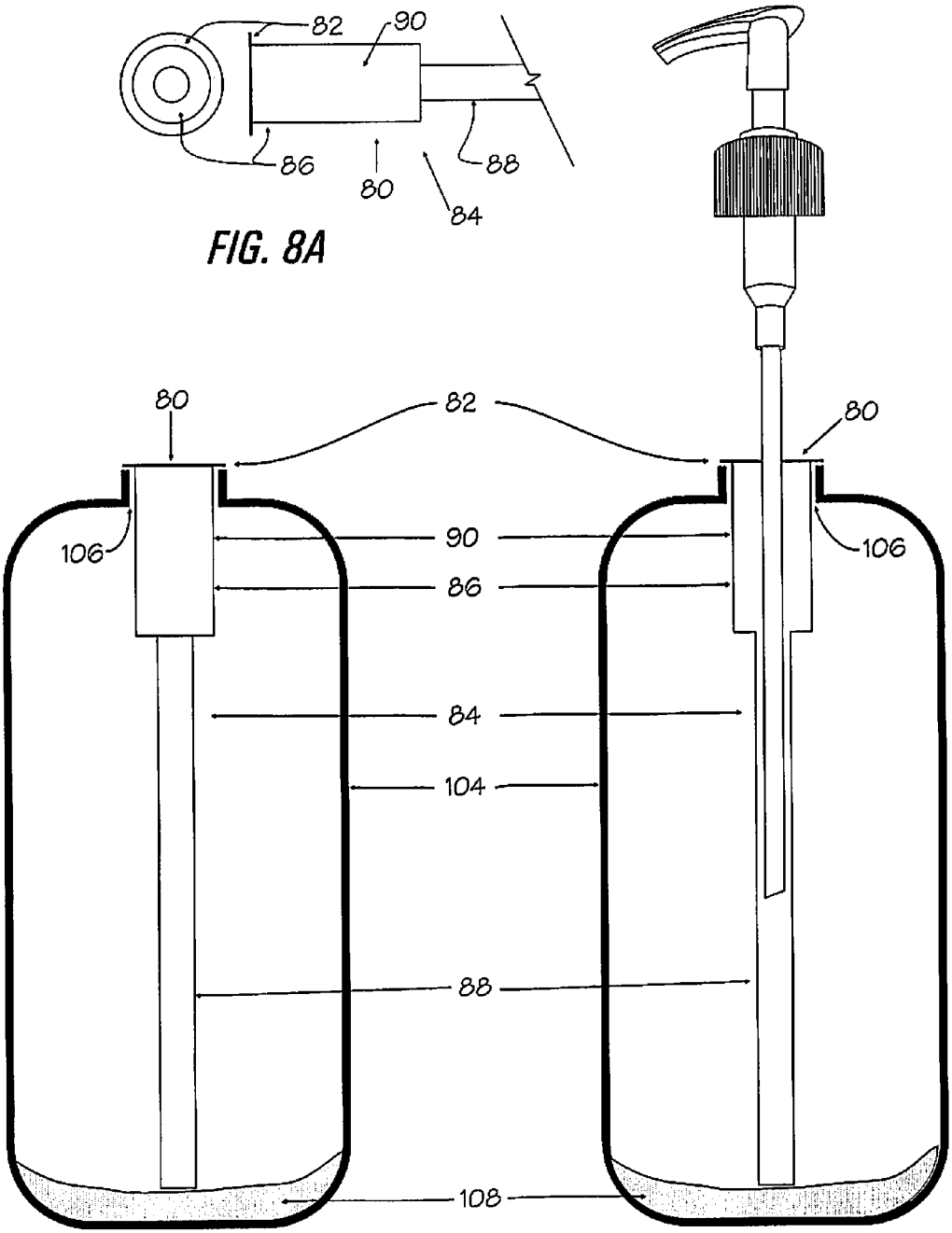
FIG. 8A is a top and partial side view of a funnel embodiment of the present disclosure.
FIG. 8B is a perspective view of the funnel embodiment of the present disclosure inserted into a bottle.
FIG. 8C is a perspective view of a pump being inserted into the funnel embodiment according to the present disclosure.

FIGS. 8A-8C are views of another embodiment of the present disclosure. The embodiment includes a funnel 80 having a circumferential plate 82 for resting on the bottleneck 106 of the bottle 104. The funnel 80 further includes an elongated tube structure 84 having a first tube 86 of a first diameter and a second tube 88 of a second diameter; the diameter of the first tube 86 is larger than the diameter of the second tube 88. The first tube 86 defines a compartment 90 therein being dimensioned and configured for placing the pump 100 therein. The second tube 88 is dimensioned and configured for receiving the tube 102 as shown by FIG. 8C.

In the various embodiments described herein, each of the following elements are collectively referred to as extractors: band 10, paddle 20, ribbon 30, spoon 40, claw 50, cup 62, and telescoping tube 72. For each of the described embodiment, these elements, and the pump 100 and pump tube 102, are part of a pump assembly. One or more of these extractors can be used in conjunction with one or more of the various embodiments described herein, including, for example, the funnel embodiment described with reference to FIGS. 8A-8C. That is, for example, band 10 can be placed on a distal end of the second tube 88 of the funnel embodiment, band 10 and paddle 20 can be placed on the distal end of the second tube 88 of the funnel embodiment, or paddle 20 can be placed on tube 102 together with paddle 20.

The present disclosure also provides a kit having a pump assembly and a plurality of extractors. Alternatively, the kit can only include the plurality of extractors. The contents of these kits can be packaged and sold as one item.

Although the present disclosure has been described in considerable detail with reference to certain embodiments, other embodiments and versions are possible and contemplated. Therefore, the spirit and scope of the appended claims should not be limited to the description of the embodiments contained herein.

The invention claimed is:

1. An extractor for fitting to a tube of a pump assembly of the type having a pump capable of being actuated for drawing contents from inside a bottle into the tube, said extractor having a flexible spoon defining a longitudinal axis there through and including at least one surface for removing contents from the bottom of the bottle, the flexible spoon is configured to flex when a force is applied thereto such that the flexible spoon changes directional orientation from a first directional orientation to a second directional orientation, wherein said spoon has a point of flexion at a location where said spoon connects to said tube.

2. The extractor according to claim 1, wherein the first directional orientation is a substantially vertical directional orientation and the second directional orientation is a non-vertical directional orientation.

3. An extractor for fitting to a tube of a pump assembly of the type having a pump capable of being actuated for drawing contents from inside a bottle into the tube, said extractor having at least one surface for removing contents from the bottom of the bottle, wherein the extractor is a spoon having a receiving member for attaching to the tube and a scooping member extending with respect to a longitudinal axis of the receiving member, wherein the scooping member is flexible for pivoting with respect to the receiving member such that a longitudinal axis defined by the length of the scooping member changes from a first direction to a second direction, wherein said spoon has a point of flexion at a location where said spoon connects to said tube.

4. The extractor according to claim 3, wherein the scooping member extends towards the bottom of the bottle when placed inside the bottle.

5. The extractor according to claim 3, wherein the first direction is a substantially vertical direction and the second direction is a non-vertical direction.

* * * * *